United States Patent [19]

Grunsten

[11] 3,941,249

[45] Mar. 2, 1976

[54] AXIAL SORTING DEVICE

[75] Inventor: Michael H. Grunsten, Oak Park, Ill.

[73] Assignee: GTE Automatic Electric Laboratories Incorporated, Northlake, Ill.

[22] Filed: Oct. 11, 1974

[21] Appl. No.: 514,164

[52] U.S. Cl. ..... 209/104

[51] Int. Cl.[2] ..... B07C 1/14

[58] Field of Search ..... 209/73, 74 R, 82, 90, 97, 209/104; 198/25; 193/14

[56] References Cited

UNITED STATES PATENTS

| | | | |
|---|---|---|---|
| 1,992,740 | 2/1935 | Chandler | 198/25 |
| 2,879,888 | 3/1959 | Miller | 209/104 |
| 3,467,253 | 9/1969 | Rossi | 209/90 X |
| 3,498,452 | 3/1970 | Aronstein et al. | 209/73 |

*Primary Examiner*—Stanley H. Tollberg
*Assistant Examiner*—Joseph J. Rolla

[57] ABSTRACT

A sorting apparatus capable of dividing lightweight axial components according to length. A pair of discs are separated by a predetermined distance and tilted above the horizontal plane with the second lower disc containing a backstop positioned on its outside surface. The item to be sorted is positioned across the discs with its first end against the backstop. If the overall length allows it to span the separation distance thereby supported by the discs it will travel through the arc of the discs as they rotate. If the length of the items is less than the separation distance of the discs, the second end of the item will fall between the discs and the item will fall onto the deflector.

2 Claims, 3 Drawing Figures

AXIAL SORTING DEVICE

BACKGROUND OF THE INVENTION

1. Field of the Invention

The present invention relates to sorting apparatus and more particularly to apparatus capable of sorting lightweight axial components to a preselected length.

2. Description of the Prior Art

In an electronics industry where automated apparatus is used to assemble electrical components it is important to ensure that an overall dimension of the component, namely its length, meets a prescribed minimum length.

While the prior art contains numerous methods of sorting items there are certain limitations present with the use of electrical components which prohibit the employment of such devices.

U.S. Pat. No. 3,467,253 which issued to O. I. Rossi on Sept. 16, 1969, discloses a method and apparatus for sorting timber by length and for the piling of the same. The apparatus comprises rectangular structures on which conveyors pass with individual timbers supported between the two conveyors. If a particular piece of lumber cannot span the distance between the conveyors it drops off, while the pieces long enough are carried onto a next conveyor system. Successive conveyors are spaced farther apart until finally they reach a drop point.

Another example of the prior art is disclosed by U.S. Pat. No. 3,715,056 which issued to Preston on Feb. 6, 1973. In Preston a sorting apparatus comprising a tooth wheel or drum having teeth is rotated in a counterclockwise direction. Items to be sorted are drawn from a hopper and disposed within the teeth of the drum by a vacuum means. If the members are less than the predetermined length between the suction passages they will fall from the drum, however if they are at least a predetermined length they will remain thereon and be transferred to a second drum. One major disadvantage of this method requires the items to be of consistent diameter over their length such that they will fully cover the inside surface of the teeth of the first wheel. The present apparatus while well suited for the separation of articles such as cigarets which contain a fairly well standardized diameter throughout their length would not be operable with an article containing in effect two diameters or one in which the diameter is very small.

OBJECTS AND SUMMARY OF THE INVENTION

In the foregoing discussion it will be understood that among the various objectives of the present invention are:

To provide a sorting device capable of sorting axial components according to length.

A further object of the present invention is to provide an apparatus capable of sorting components whose ratio of length to cross section diameter is very large.

A further object of the present invention is to provide an apparatus capable of sorting components to a predetermined length without damaging or deforming the component.

Another object of the present invention is to provide an apparatus capable of sorting individual components of a variable weight and structural configuration.

These and other objectives of the present invention are effectively achieved by providing an axial component sorting device comprising two rotating discs connected together by a spacer and inclined from the horizontal such that the first disc is above the second.

A backstop is positioned on the outside surface of the lower disc, such that when the components are fed axially to the edges of the discs, the first end of the component will strike the backstop and fall within one of the teeth on the disc. If the length of the component is equal to or greater than the separation between the discs, the other end will come to rest on top of the second disc. However, if the overall length of the component is less than the separation between the discs, the second end will drop between the discs and onto a deflector. If the component is supported by the discs, it will be carried to the bottom of the disc rotation and drop out of the teeth due to the force of gravity. The component then drops onto the other side of the deflector and thereby is separated from the rejected components.

Inasmuch as the rejection length of a component is determined by the length of the spacer between the rotating discs it becomes only a simple task to vary the rejection length by replacing one spacer with a longer or shorter one.

The foregoing as well as other objects, features and advantages of the present invention will become more apparent from the following detailed description taken into conjunction with the appended drawings.

A BRIEF DESCRIPTION OF THE DRAWINGS

PREFERRED EMBODIMENT

Figure 1:
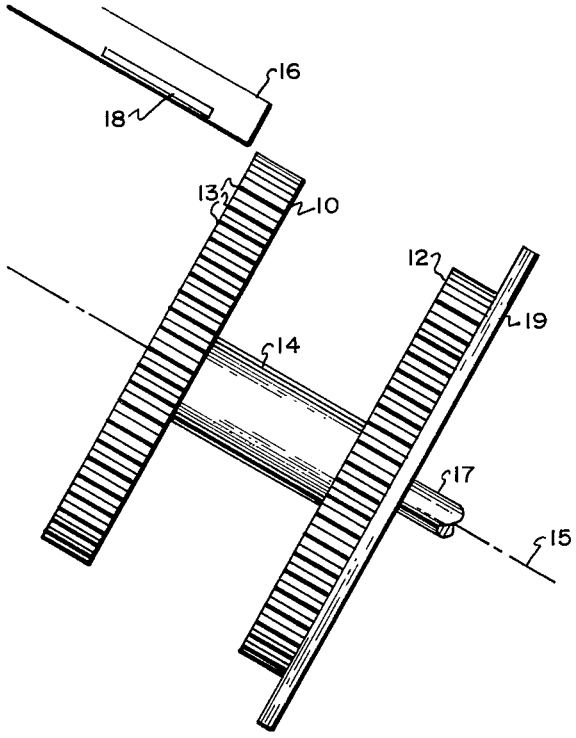
FIG. 1 shows a side view of the axial sorting device with the delivery means in position.

With reference to FIG. 1 the sorting apparatus comprises three elements, a first disc 10 and a second disc 12 and a spacer 14 mounted on a rotatable axle 17. The discs 10 and 12 contain surface indentations 13 which form the disc teeth. The overall structure is tilted and rotates about an axis 15 which is inclined from the horizontal such that the first disc 10 is disposed above the second disc 12. A backstop 19 is secured to the outer surface of the second disc 12. When components 18 pass over the rotating discs, the first end of the component will strike the backstop 19 thereby causing the component 18 to drop onto the discs. If the overall length of the component 18 is greater than the separation between the discs 10 and 12, and the width of one of the discs, it will be supported by the two discs and carried by teeth 13 as the discs rotate, however if the length is less than the separation distance and the width of one of the discs, the component will only be supported by disc 12 and the other end will fall between the discs. A delivery device 16 is utilized in order to bring the component 18 into appropriate close proximity, height and angle to the discs such that the components will strike the backstop 19.

Figure 2:
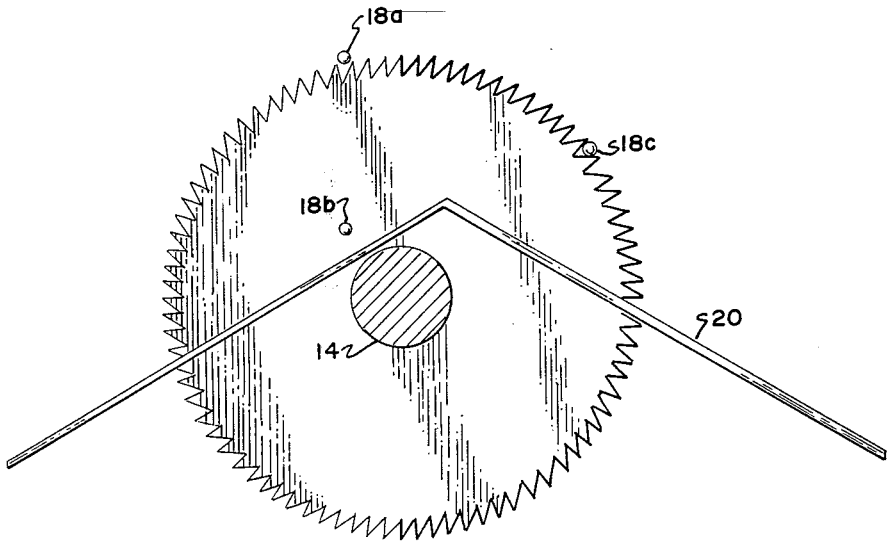
FIG. 2 is a cutaway side view of the rotatable discs with the chute in position showing the sorting of a rejected and proper length component.

As shown in FIG. 2 a deflector 20 is positioned between the discs above and overlapping the spacer 14. The position of the deflector is dependent upon the position of the delivery device 16, the only criterion being that once the component makes contact with the backstop 19 and disc 12 it should pass over both faces of the deflector 20 if a double-face deflector is employed. Three individual components are shown in FIG. 2, 18*a* represents a component after leaving the delivery device 16 before making contact with the discs and the backstop. 18*b* represents a component which has been rejected because its overall length did not span the distance between the discs 10 and 12. This component is passing down to reject side of the deflector. 18*c* represents a component whose overall length is adequate to span the distance between the discs 10 and 12, such that it rides through the arc of the discs before being dislodged from the teeth 13 by the force of gravity.

Figure 3:
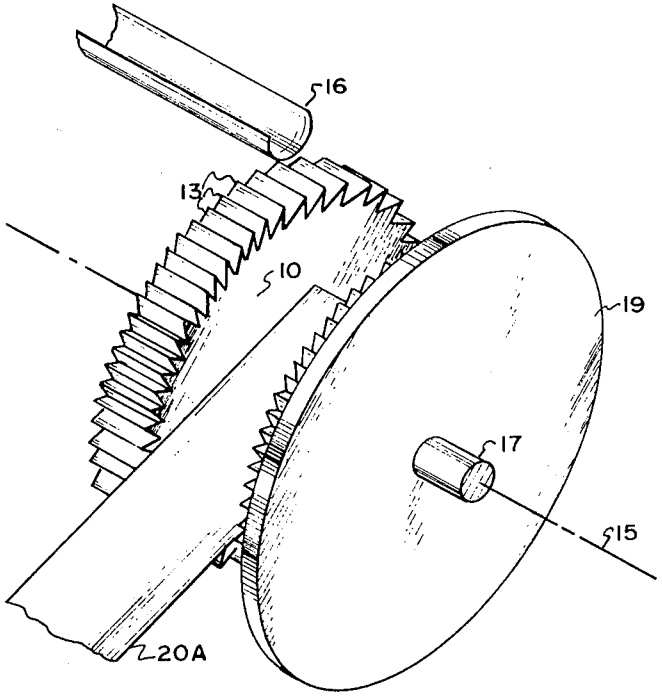
FIG. 3 is a perspective view of the axial sorting device with the delivery means and deflector in position.

FIG. 3 is another view of the axial sorting apparatus with the delivery device 16 and a single ramp deflector 20*a*.

From the foregoing it will be seen that the applicant has provided an improvement in sorting devices whereby the objectives set forth hereinabove are effectively met.

Since certain changes in the above described construction will credit those skilled in the art without departure from the scope of the invention it is intended that all matter contained in the preceding instruction or shown in the appended drawings shall be interpreted as illustrative and not in a limiting sense.

What is claimed is:

1. An axial sorting apparatus comprising:

first and second circular rotatable discs disposed parallel to each other and centered on a common axis, each of said discs having a plurality of slots on its outer rim;

at least one spacer separating said discs and secured on its center through said axis to the inside surfaces of said first and second rotatable discs;

backstop means positioned against the outside surface of said second rotatable disc and having a diameter greater than said second rotatable disc;

component delivery means positioned outside of said first rotatable disc;

deflector means disposed between said discs for separating the undersized component which falls between said discs and the proper sized components, said deflector means comprising two substantially perpendicular planar surfaces intersecting along a line parallel to and displaced from the axis of the spacer and extending downwardly.

2. An axial sorting apparatus as claimed in claim 1 wherein the axis of said rotatable discs is inclined upward from the horizontal plane such that said first disc is disposed above said second disc to ensure that the component to be sorted would be flush with the outside surface of the lower disc against said backstop.

* * * * *